United States Patent [19]

Acheson

[11] 4,292,805

[45] Oct. 6, 1981

[54] SERVO-VALVE CONVERTIBLE CONSTRUCTION

[75] Inventor: John L. Acheson, Franklin, Wis.

[73] Assignee: Rexnord Inc., Milwaukee, Wis.

[21] Appl. No.: 78,332

[22] Filed: Sep. 24, 1979

[51] Int. Cl.[3] ..... F04B 1/26; F04B 49/08; F16H 39/46

[52] U.S. Cl. ..... 60/450; 60/452; 417/218; 417/222

[58] Field of Search ..... 60/450, 452; 417/222, 417/218

[56] References Cited

U.S. PATENT DOCUMENTS

| | | | |
|---|---|---|---|
| 2,238,061 | 4/1941 | Kendrick | 60/450 |
| 3,246,471 | 4/1966 | Goodale | 60/450 X |
| 3,486,334 | 12/1969 | Miller | 60/450 |
| 3,549,281 | 12/1970 | Schink et al. | 418/31 |
| 3,635,021 | 1/1972 | McMillen et al. | 417/213 X |
| 3,768,928 | 10/1973 | Miller et al. | 417/222 |
| 3,856,436 | 12/1974 | Lonnemo | 60/450 X |
| 3,935,706 | 2/1976 | Stevens | 60/450 X |
| 4,132,506 | 1/1979 | Dantigraber | 417/218 |

*Primary Examiner*—IrwinC. Cohen

[57] ABSTRACT

A hydraulic system includes an actuator and a motor driven pump. A servo-control valve adjusts the displacement of the pump and provides a stable response to pump output pressure variations. The servo-valve is adapted for the addition of a control piston which operates against the spool of the servo-valve to modulate its operation in response to a moderate pressure drop across a restriction placed in the line from the pump to the actuator.

8 Claims, 5 Drawing Figures

SERVO-VALVE CONVERTIBLE CONSTRUCTION

BACKGROUND OF THE INVENTION

A preferred servo-valve is shown and described in detail in U.S. Pat. No. 3,549,281 which also shows in section a variable displacement van pump and the two pistons and biasing spring which adjust the position of an outer ring and the displacement of the pump.

It is an object of the present invention to provide means which can be readily added to this valve which will convert the valve to one which adjusts the displacement of the pump in response to the rate of flow of the pump output rather than pump output pressure.

SUMMARY OF THE INVENTION

A hydraulic system includes a servo-valve having a valve spool movable in one direction by pump output pressure against an adjustable spring to control a pilot pressure which adjusts pump displacement to maintain a selected pump output pressure. To convert the system so that pump displacement is adjusted according to pump output or rate of flow, a moderate restriction is placed in the pump delivery line and a spring biased piston and cylinder are added to the valve body and connected to the line so that the pressure drop across the line restriction limits movement of the spool such that its control of the displacement of the pump is adjusted accordingly and to maintain a given rate of flow.

DESCRIPTION OF THE PREFERRED EMBODIMENT SHOWN IN THE DRAWINGS

Figure 1:
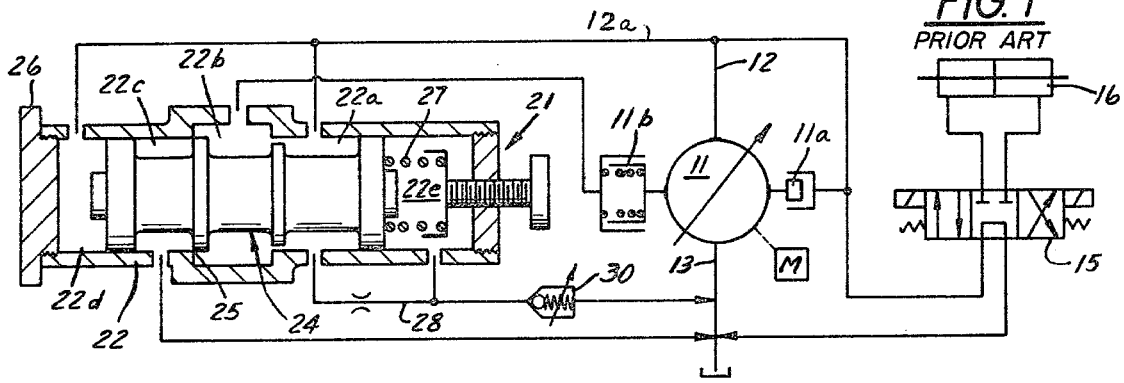
FIG. 1 PRIOR ART
FIG. 1 shows a servo valve in section. The other parts of a hydraulic system are shown by conventional symbols.

The variable displacement pump 11 is driven by motor M. The pump output line 12 and the return line 13 from the sump are connected to the solenoid operated spring centered four way valve 15. The double actuator 16 represents whatever hydraulic motor might be driven by pump 11 and as shown is connected to valve 15.

Pump 11 includes the smaller and larger control pistons 11*a* and 11*b*. Piston 11*a* (which corresponds with piston 91 of U.S. Pat. No. 3,549,281) is connected to line 12 so that the output pressure of the pump is effective to reduce pump displacement as required. The spring biased control piston 11*b* (which corresponds with control piston 91*a* of patent 3,549,281) is connected to line 12 through the servo-valve 21 as will be described and so that a control pressure derived from the output of pump 11 is effective to increase pump displacement as required.

Figure 3:
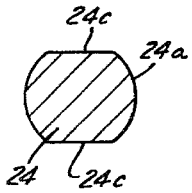
FIG. 3 is a section taken on line 3—3 of FIG. 2 to show the flats of one land of the spool.
Figure 2:
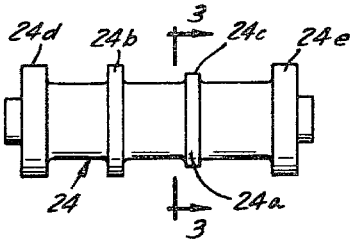
FIG. 2 shows the spool of the valve of FIGS. 1 and 4.

Valve 21 includes the valve body 22 having a bore in which the spool 24 of FIG. 2 is axially movable. The two spool lands 24*a* and 24*b* define the three chambers 22*a* and 22*b* and 22*c* (See FIG. 1) between the ends 24*d* and 24*e* of the spool. Passages from chamber 22*a* to 22*b* are provided by the flats 24*c* which are shown in FIG. 3. A variable passage is also provided from chamber 22*b* to chamber 22*c* between land 24*b* and the corner of the stepped bore as at 25. The mentioned passages are restricted and will be referred to as restriction V1 and the variable passage will be referred to as restriction V2.

Chamber 22*a* is connected by line 12*a* to line 12 and chamber 22*c* to return line 13 so that a variable pilot flow from pump 11 normally passes restrictions V1 and V2. Chamber 22*b* is connected to pump 11 so that the (control) pressure of the flow intermediate restrictions V1 and V2 operates against the control piston 11*b*. Thus, movement of spool 24 to the left as shown, closes restriction V2 at step 25 and the control pressure approaches pump output pressure. Conversely, spool movement to the right opens restriction V2 and the control pressure drops toward the input (or charge) pressure in return line 13.

The chamber 22*d* at one end of valve body 22 is closed by the threaded plug 26 and is directly connected to line 12*a*. The spring 27 in the chamber 22*e* at the other end of valve body 22 biases spool 24 toward said one end of the valve body and is manually adjustable externally.

As shown, chamber 22*a* is connected to chamber 22*e* by the restricted line 28 and chamber 22*e* is connected to return line 13 through the adjustable pressure relief valve 30 which is set at the desired pump output pressure. At start-up and until that pressure is reached, spring 27 holds valve spool 24 against plug 26 such that the restriction V2 is closed and the land 24*a* is positioned in chamber 22*b* such that restriction V1 is removed. The pump output pressure from line 12 and 12*a* through chambers 22*a* and 22*b* is applied to piston 11*b* and pump 11 is held at full stroke. In the event of a sudden excessive pressure in the system, the excessive pressure in chamber 22*d* pushes spool 24 to the right as shown against spring 27. This restores restriction V1 and opens the restriction V2 and allows line pressure to reduce pump displacement immediately. The fluid in chamber 22*e* is isolated from the sudden pressure by the restricted line 28 and flows through valve 30 to return line 13.

The adjustment of spring 27 essentially changes the normal location of land 24*b* of the spool with respect to the step 25 of the valve bore and the degree of the second restriction V2 of the pilot flow which operates against piston 11*b* under normal operating conditions. That is, valve 30 is set at the desired output pressure to be maintained and spring 27 is adjusted so that the pressure is provided against piston 11*b* as has been described and which is required to balance the output pressure operating against piston 11*a*.

Under normal operating conditions and with spring 27 adjusted as required, the pump output pressure opens valve 30 so that a very small fraction of the pump output is allowed to flow from chamber 22*a* through line 28 and the valve 30 to return line 13. The amount of such flow which is restricted by line 28 is such that the pressure in chamber 22*a* is less than the pressure in chamber 22*d* by an amount depending on the rate of flow which varies with pump output pressure. As the described pressure differential increases, spool 24 is moved to the right and restriction V2 is opened slightly to reduce pump displacement. Similarly, as the pressure differential decreases the reduced pressure allows spring 27 to move spool 24 and close (slightly) the restriction V2 and increase pump displacement.

In the event of a sudden increase in output pressure such as might be due to an obstruction encountered by actuator 16, spool 24 is moved to the right, restriction V2 is opened and pump displacement is immediately reduced as previously described.

The present invention is directed to the modification of valve 21 which does not affect this function or its function which is to maintain the pump at full stroke at start up and at low loads or output pressure.

Figure 4:
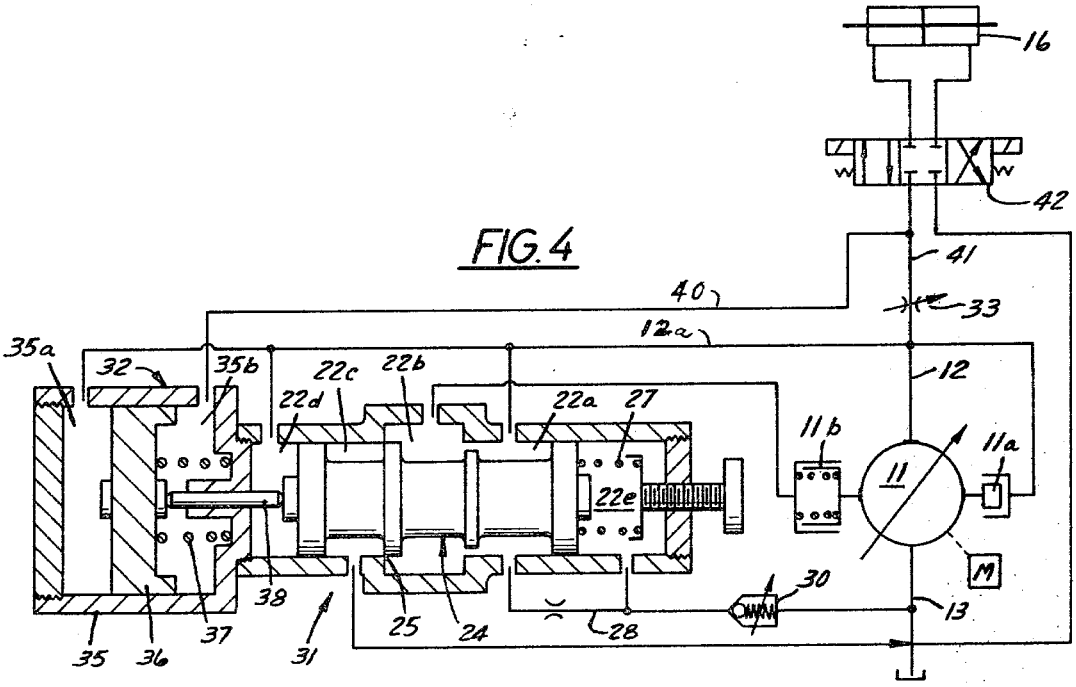
FIG. 4 shows an hydraulic system with the servo-valve in section and as modified according to the invention. The restriction in the pump output line is also shown. The solenoid operated reversing valve in its center position as shown closes the pump output line.

The servo-valve 31 of FIG. 4 is identical to servo-valve 21 except that the control device 32 has been substituted for plug 26 and line 12 is connected to the adjustable flow restrictor 33. Control device 32 includes the cylinder 35, the piston 36 which is biased in one direction by the spring 37 and the pin 38 which is moved in the other direction by the piston.

The threaded end of cylinder 35 is attached to valve body 22 to close chamber 22 and position pin 38 to contact the end of spool 24. Chamber 35*a* of cylinder 35 is connected by line 39 to line 12*a* and chamber 35*b* is connected by line 40 to line 41 which connects restrictor 33 and the solenoid operated four way valve 42. Valve 42 is connected to the actuator 16 and is similar to valve 15 except that in its center position, line 41 is closed, rather than being connected to return line 13.

The added control device 32 of servo-valve 31 operates in response to the pressure difference in chambers 35*a* and 35*b* to limit the movement of spool 24 to the left as shown and the degree to which the land 24*b* may approach the step 25 and reduce the second restriction V2 of the pilot flow and thus limit the displacement of pump 11 in response to the pressure differential referred to.

An understanding of the operation of the invention may be aided by noting first that spring 37 is of considerable stiffness, compared with that of spring 27 and the effective length of pin 38 may require some initial adjustment. The effective length is conveniently adjusted for example with shims, not shown, at either end of spring 37.

Restrictor 33 effects a pressure drop at the desired rate of flow so that the line pressure in line 41 and in chamber 35*b* is reduced and has the effect of allowing the pressure in chamber 35*a* to move piston 36 and compress spring 37 slightly. Such movement pushes pin 38 to engage or push spool 24 to the right, as shown. In effect, of course, pin 38 is of the nature of an abutment and the position of such abutment is varied within a very small range of movement.

The effect of a readjusting of spring 27 is not critical and it should be noted that the output pressure at the selected rate of flow must be less than the setting of valve 30. Conversely, valve 30 may be set at any pressure higher than that required for the desired rate of flow. It should be noted also that under normal conditions there is no secondary flow through valve 30 as in the operation of servo-valve 21 and the same pressure in chambers 22*d* and 22*e* is applied against the two ends of the spool. However, spool 24 is moved away from pin 38 (to the right) at any time in the event of a sudden overpressure and in order to open restriction V2, which lowers the control line pressure, and immediately allows the pump output pressure in line 12 to reduce pump displacement.

Several examples of the use of the flow control valve of the present invention will be described with reference to the drawings. In the hydraulic system of FIG. 4, the motor M may be an internal combustion engine driving other equipment and operating at widely varying speeds. While engine (M) is idling or is operating under load at reduced speed, and if the operation of actuator 11 is critical, pump displacement is adjusted accordingly. When engine M is operating the equipment at full speed pump displacement is reduced so that the actuator 16 does not over-speed. Valve 42 in its center position closes line 41 and the excess pressure which immediately develops in chamber 22*a* moves spool 24 fully to the right (and from pin 38) so that the pressure against piston 11*b* is reduced, as described having reference also to valve 21. The pump then operates at its "dead head" position where its displacement is just enough to replace all internal leakages. In the same example, valve 15 may be substituted for valve 42. Valve 42 in its center position returns the pump output directly to the sump. Under such conditions, both piston 36 and spool 24 are positioned fully to the left respectively by springs 37 and 27 and the output pressure against piston 11*b* adjusts pump 11 to full displacement. This may be preferred as when valve 15 reconnects pump 11 to actuator 16. The same mentioned equipment may also include some number of other pumps also driven by motor or engine M to operate other actuators. Generally, a constant output pressure is required where several actuators are driven by the output of one pump. Such regulation may be provided by one or more valves 21 such that all the valves 21 and 31 of the equipment in this example are essentially the same, except as indicated.

In another example of the use of the invention, the motor M may be a D.C. electric motor having a speed which varies inversely with the load. In this system, the actuator 16 commonly overspeeds when unloaded unless the flow control of FIG. 4 or the like is provided, or unless other more expensive control means is provided. In this example, if the associated equipment is to be revised and pump 11 is then to be driven by a larger or a constant speed A.C. motor, valve 31 is readily modified by replacing control device 32 with a plug 26 and removing or opening restrictor 33 whereby the system of FIG. 1 may be provided on a temporary or permanent basis. The reverse modification is equally possible according to the invention. In particular, it should be noted that with either modification, the effective area of the end of spool 24 and the operation of valve 31 as such remains unchanged.

Figure 5:
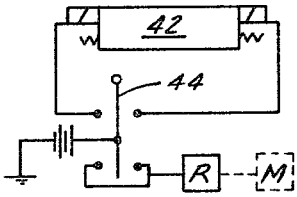
FIG. 5 is an electrical circuit diagram. The circuit includes a motor relay which shuts off the motor when the reversing valve of FIG. 4 is in its center position.

In another example of the use of the invention, the motor M may be a battery operated D.C. motor which is controlled by the relay R of FIG. 5. In this example, the motor is shut off by the switch 44 whenever the spring centered valve 42 is in its closed position. This reduces the drain on the battery. In this example particularly, restrictor 33 may be provided with a manually operated adjustment lever which is combined with switch 44, to provide a single lever speed control of actuator 16.

The hydraulic systems of both FIGS. 1 and 4 operate the actuator in either direction. In other systems and also in the above examples, the load may be unidirectional.

I claim:

1. A control valve in combination with a hydraulic system which includes a variable displacement pump and a flow restrictor, an output line therebetween, a delivery line from the restrictor for connection to a load, a return line and a control displacement line to the pump, means responsive to output line pressure acting to reduce pump dislacement, the pump displacement being varied directly by pressure variations in said displacement control line acting on pressure responsive displacement control means; said valve including a valve body and a spool which is axially movable therein and defines therewith first and second restricted passages, said valve body having means for connection with said output, displacement controls, and return lines to provide a pilot flow of fluid from the output line and through said passages to the return line and to the displacement control of line for varying pump displacement by the pressure intermediate said passages, a spring biasing said spool in one direction and toward one end of the valve body to close said second passage to the return line to raise the pressure in the displacement control line whereby pump displacement is increased, and means for connecting said one end of the valve body with the output line whereby pump output pressure is effective to move the spool in the other direction and against said spring and to open said second passage to the return line to lower pressure in the displacement control line whereby pump displacement is decreased; said valve further including a spool abutment device comprising a cylinder, a piston movable therein, a spring biasing said piston in one direction and toward one end of the cylinder, an axially movable pin extending from the piston and through the other end of the cylinder, means removably connecting said other end of the cylinder to said one end of the valve body whereby the pin is engageable by abutting the spool and only limits movement of the spool in said one direction only, and means for connecting said one end of the cylinder with the output line and the other end of the cylinder with the delivery line such that the pressure differential effected by the restrictor and operating against said piston and last named spring positions said pin in accordance with said pressure differential and allows pump displacement to be varied only up to a selected maximum pump output and without otherwise interfering with the operation of the control valve.

2. The control valve of claim 1 wherein the second spring is operable to move the piston fully in said one direction and allow the first spring to move the spool fully in said one direction and to close said second passage and open the first passage such that pump displacement is increased while the pump output pressure is less than the effective pressure differential.

3. The control valve of claim 1 wherein the first spring is yieldable to an excess pressure in said one end of the valve body and the spool is movable by such excess pressure away from the pin and fully in said other direction to open the second passage whereby pump displacement is decreased.

4. The control valves of claim 1 wherein the valve further includes restricted means connecting the other end of the valve body with the return line and a pressure relief valve from said other end of the valve body such that a sudden excess pressure in the output and/or delivery line moves the spool as described to decrease pump displacement immediately irrespective of the position of the pin.

5. A hydraulic system which includes a variable displacement pump, a flow restrictor, an output line therebetween, an actuator, a delivery line to the actuator from the restrictor, a control valve, a return line and a displacement control line to the pump, means responsive to output line pressure acting to reduce pump displacement the pump displacement being varied directly by pressure variations in said displacement control line acting on pressure responsive displacement control means; said valve including a valve body and a spool which is axially movable therein and defines therewith first and second restricted passages, said valve body having means for connection with said output, displacement control, and return lines to provide a pilot flow of fluid from the output line and through said passages to the return line and to the displacement control line for varying pump displacement by the pressure intermediate said passages, a spring biasing said spool in one direction and toward one end of the valve body to close said second passage to the return line to raise the pressure in the displacement control line whereby pump displacement is increased, and means for connecting said one end of the valve body with the output line whereby pump output pressure is effective to move the spool in the other direction and against said spring and to open said second passage to the return line to lower pressure in the displacement control line whereby pump displacement is decreased; said valve further including a spool abutment device comprising a cylinder, a piston movable therein, a spring biasing said piston in one direction and toward one end of the cylinder, an axially movable pin extending from the piston and through the other end of the cylinder, means removably attaching said other end of the cylinder to said one end of the valve body whereby the pin is engageable by abutting the spool and only limits movement of the spool in said one direction only, and means for connecting said one end of the cylinder with the output line and the other end of the cylinder with the delivery line such that the pressure differential effected by the restrictor and operating against said piston and last named spring positions said pin in accordance with said pressure differential and limits pump displacement to maintain a selected maximum pump output without interfering with the operation of the control valve as to pump outputs below said maximum.

6. The hydraulic system of claim 5 wherein the second spring of the control valve is operable to move the piston fully in said one direction and allow the first spring to move the spool fully in said one direction and to close said second passage and open the first passage such that pump displacement is increased while the pump output pressure is less than the effective pressure differential.

7. The hydraulic system of claim 5 wherein the first spring of the control valve is yieldable to an excess pressure in said one end of the valve body and the spool is movable by such excess pressure away from the pin and fully in said other direction to open the second passage whereby pump displacement is decreased.

8. The hydraulic system of claim 5 wherein the control valve further includes restricted means connecting the other end of the valve body with the return line and a pressure relief valve from said other end of the valve body such that a sudden excess pressure in the output line moves the spool as described to decrease pump displacement immediately.

* * * * *